US005757122A

United States Patent [19]

Kim

[11] Patent Number: 5,757,122

[45] Date of Patent: May 26, 1998

[54] MAGNET ASSEMBLY FOR A COLOR RAY TUBE

[75] Inventor: Gyoo-Hwan Kim, Seoul, Rep. of Korea

[73] Assignee: L.G. Electronics, Inc., Seoul, Rep. of Korea

[21] Appl. No.: 603,292

[22] Filed: Feb. 20, 1996

[30] Foreign Application Priority Data

Feb. 20, 1995 [KR] Rep. of Korea ..... 1995-3222

[51] Int. Cl.[6] ..... H01J 29/54; H01F 1/02

[52] U.S. Cl. ..... 313/440; 335/211; 335/212

[58] Field of Search ..... 313/431, 427, 313/428, 440; 335/211, 212, 210; 292/257; 403/330

[56] References Cited

U.S. PATENT DOCUMENTS

| | | | |
|---|---|---|---|
| 3,504,551 | 4/1970 | Bohenek | 292/257 |
| 3,902,145 | 8/1975 | Slavenburg et al. | 335/212 |
| 4,157,146 | 6/1979 | Svenson | 292/257 |
| 5,108,216 | 4/1992 | Geyer et al. | 292/257 |
| 5,289,149 | 2/1994 | Nishita et al. | 335/210 |

*Primary Examiner*—Sandra L. O'Shea
*Assistant Examiner*—Joseph Williams
*Attorney, Agent, or Firm*—Bell, Boyd & Lloyd

[57] ABSTRACT

A magnet assembly for a CRT, installed in the outer periphery of a neck portion incorporating an electron gun for emitting R, G and B electron beams for converging the electron beams on the center of a screen is disclosed. The magnet assembly includes a magnet support inserted into the outer periphery of the neck portion, a pair of two-, four- and six-pole magnet rings rotatably installed in the outer periphery of the magnet support, spacers inserted between the each pair of magnet rings, and a magnet fixing means rotatably coupled in the outer periphery of the magnet support for fixing the magnet support on the neck portion and preventing the magnet rings and the spacer from being fluctuated on the magnet support.

4 Claims, 5 Drawing Sheets

MAGNET ASSEMBLY FOR A COLOR RAY TUBE

FIELD OF THE INVENTION

The present invention relates to a magnet assembly for a color ray tube (CRT), and more particularly, to a magnet assembly for a CRT which allows easy fabrication and simplified construction.

BACKGROUND OF THE INVENTION

A conventional CRT is provided with an electron gun 3 for emitting three electron beams (R, G and B) within a neck portion 2, and a magnet assembly 10 for uniting the R, G and B electron beams emitted from electron gun 3 in the outer periphery of the electron-gun incorporating neck portion 2, as shown in FIG. 1.

Magnet assembly 10 includes a magnet support 30 fixedly inserted into the outer periphery of neck portion 2, a pair of two-, four- and six-pole magnet rings 40, 50 and 60 rotatably installed in the outer periphery of magnet support 30, spacers 70 inserted between the respective pairs of magnet rings, a magnet fixture 80 having an inner peripheral surface screw 81 screw-coupled to an outer peripheral surface screw 31 of magnet support 30 for preventing the fluctuation of the respective magnet rings 40, 50 and 60 and spacer 70 on magnet support 30, and a ring band 20 coupled to the upper end of magnet support 30 for closely fixing magnet support 30 on neck portion 2 according to the engagement of a bolt 21, as shown in FIG. 2.

Two-, four- and six-pole magnet rings 40, 50 and 60 are formed such that north and south poles are disposed in terms of 180°, 90° and 60°, respectively.

If R, G and B electron beams emitted electron gun 3 are not converged on the center of a screen 4 due to various errors exhibited during a manufacturing process of such a CRT, two-, four- and six-pole magnet rings 40, 50 and 60 of magnet assembly 10 installed in the outer periphery of neck portion 2 are turned in the peripheral direction of neck portion 2 to converge the three electron beams on the center of screen 4. Then, magnet fixture 80 is screw-coupled to magnet support 30 to prevent the fluctuation of the respective magnet rings.

As described above, in order to fixedly install magnet assembly 10 on neck portion 2, bolt 21 of ring band 20 should be rotated by a driver. Also, in order to prevent the fluctuation of the respective magnet rings, magnet fixture 80 should be screw-coupled to magnet support 30. Therefore, a lot of assembly operation time is required. Also, the manufacturing cost is increased due to a lot of assembly parts.

SUMMARY OF THE INVENTION

It is an object of the present invention to provide a magnet assembly for a CRT which simplifies its configuration by reducing the number of assembly parts and facilitates the assembly.

To accomplish the above objects, there is provided a magnet assembly for a CRT, installed in the outer periphery of a neck portion incorporating an electron gun for emitting R, G and B electron beams for converging the electron beams on the center of a screen, the magnet assembly comprising: a magnet support inserted into the outer periphery of the neck portion; a pair of two-, four- and six-pole magnet rings rotatably installed in the outer periphery of the magnet support; spacers inserted between the each pair of magnet rings; and a magnet fixing means rotatably coupled in the outer periphery of the magnet support for fixing the magnet support on the neck portion and preventing the magnet rings and the spacer from being fluctuated on the magnet support.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
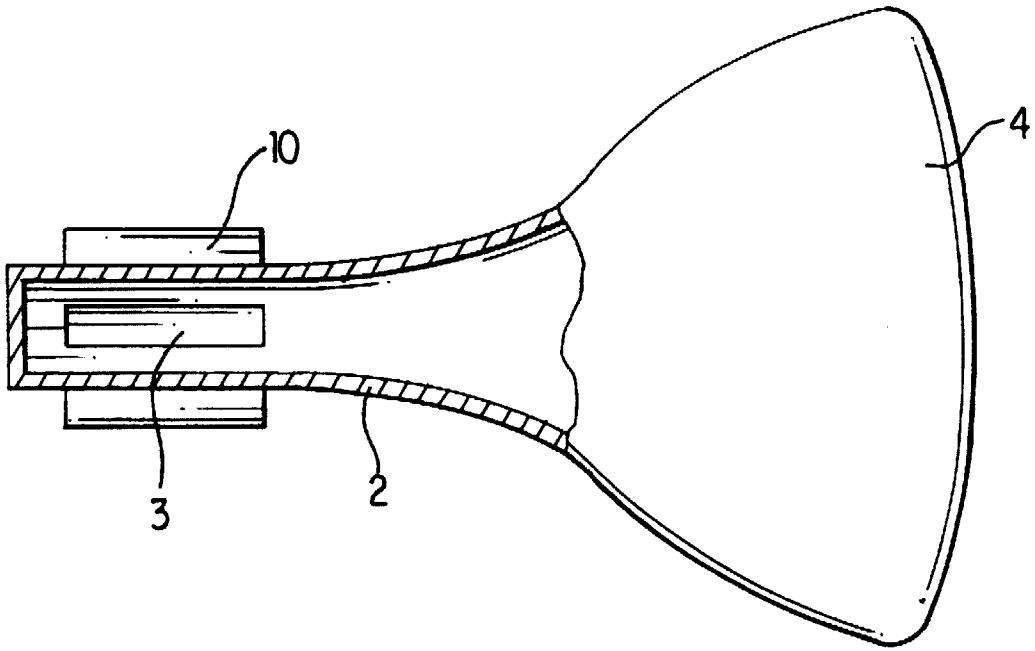
FIG. 1 is a schematic diagram of a conventional CRT.
Figure 2:
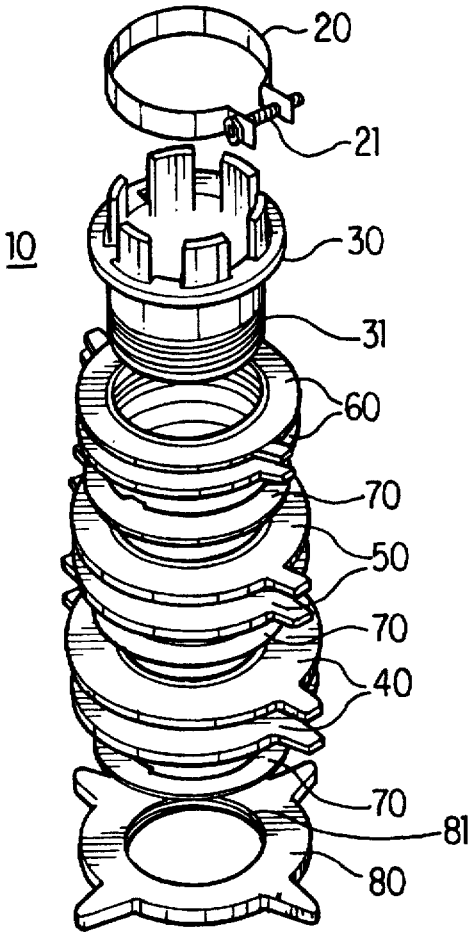
FIG. 2 PRIOR ART
FIG. 2 is an exploded perspective view of the conventional CRT.
Figure 3:
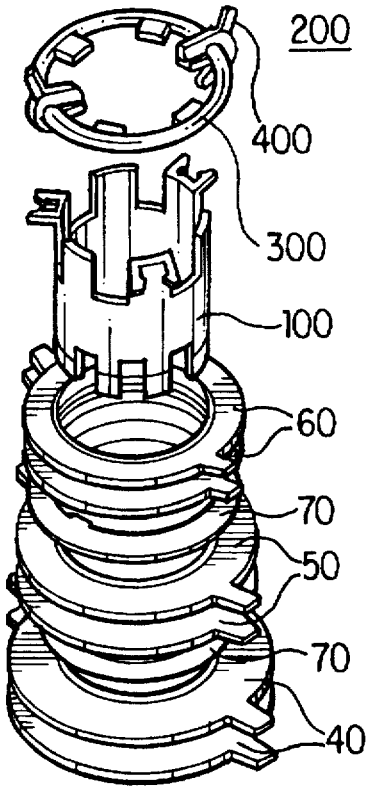
FIG. 3 is an exploded perspective view of a magnet assembly for a CRT according to a first embodiment of the present invention.

As shown in FIG. 3, a magnet assembly for a CRT according to the present invention includes a magnet support 100 inserted into the outer periphery of a neck portion, a pair of two-, four- and six-pole magnet rings 40, 50 and 60 rotatably installed in the outer periphery of magnet support 100, each spacer 70 inserted between the each pair of magnet rings, and a magnet fixture 200 coupled in the outer periphery of magnet support 100 for fixing magnet support 100 on the neck portion and preventing magnet rings 40, 50 and 60 and spacer 70 from being fluctuated on magnet support 100.

Figure 4:
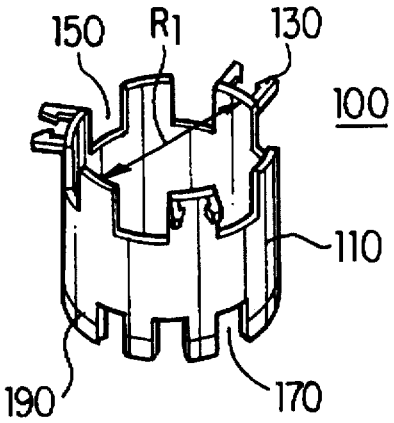
FIG. 4 is a perspective view of a support for the magnet assembly for a CRT according to a first embodiment of the present invention.

As shown in FIG. 4, magnet support 100 includes a cylindrical main body 110, a hook 130 installed in one end of main body 110, a plurality of nodes 150 formed in one end having hook 130 installed therein in a lateral direction of main body 110 in a predetermined interval, a node 170 formed in other end of main body 110, and a flange 190 formed in other end of main body 110.

Figure 5:
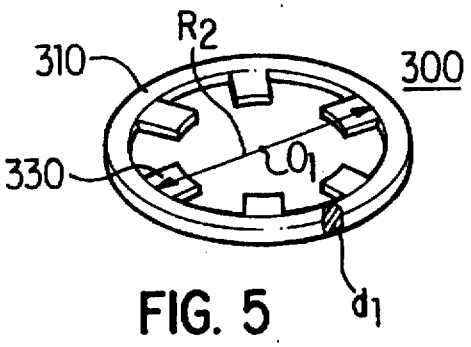
FIG. 5 is a perspective view of a first fixture for the magnet assembly for a CRT according to a first embodiment of the present invention.
Figure 6:
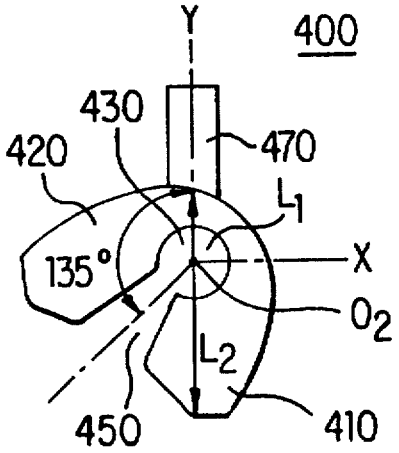
FIG. 6 is a perspective view of a second fixture for the magnet assembly for a CRT according to a first embodiment of the present invention.

Magnet fixture 200 includes a first fixture 300 coupled to magnet support 100 and a plurality of second fixtures 400 rotatably coupled to first fixture 300, as shown in FIGS. 5 and 6.

First fixture 300 includes a ring 310 having a curvature radius ($D_2$) larger than the radius ($D_1$) of main body 110 and having a circular section having a diameter of $d_1$, and a plurality of extensions 330 elongated toward a center $\mathbf{0}_1$ of ring 310, as shown in FIG. 5.

Second fixtures 400 each includes first and second cams 410 and 420 integrally formed and having a common rotary centroid $\mathbf{0}_2$, a circular hole 430 having a diameter corresponding to the diameter $d_1$ of ring 310 around the rotary centroid $\mathbf{0}_2$, and into which ring 310 is inserted, a node 450 linked to circular hole 430 and externally enlarged therefrom, and an arm 470 formed at about 135° clockwise in terms of node 450 and inserted into hook 130, as shown in FIG. 6. First and second cams 410 and 420 of second fixtures 400 are formed so that the length $L_1$ of one cam is different from the length $L_2$ of the other in view of the rotary centroid $\mathbf{0}_2$.

The operation of the magnet assembly for a CRT according to the present invention will now be described.

Ring 310 of first fixture 300 is inserted into circular hole 430 through node 450 of second fixtures 400 to complete magnet fixture 200 constituted by first fixture 300 and second fixtures 400. In such a state, second fixtures 400 are capable of rotation in terms of the rotary centroid $\mathbf{0}_2$ of circular hole 430 into which ring 310 of first fixture 300.

Next, magnet fixture 200, spacer 70, as conventionally, a pair of six-pole magnet rings 60, spacer 70, a pair of four-pole magnet rings 50, spacer 70 and a pair of two-pole magnet rings 40 are sequentially inserted into the periphery of magnet support 100 through one end of magnet support 100 having node 170 and whose outer diameter can be elastically varied, thereby completing the magnet assembly.

The various parts inserted into magnet support 100 in such a way are not out of position by flange 190 formed in one end of elastically-restored magnet support 100.

Then, the magnet assembly is installed in the outer periphery of the neck portion having an integrally formed electron gun and the respective magnet rings 40, 50 and 60 are rotated in a suitable manner to converge the R, G and B electron beams emitted from the electron gun.

Figure 7:
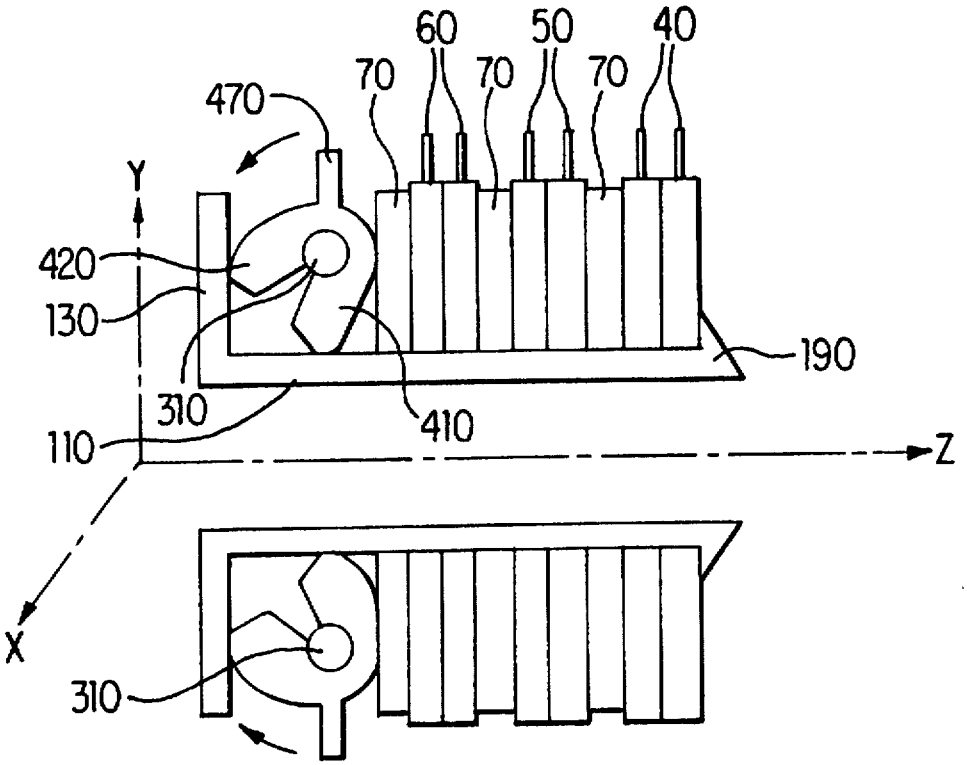
FIG. 7 shows a fabrication state of the magnet assembly for a CRT according to a first embodiment of the present invention.

Next, as shown in FIG. 7, if second fixture 400 of magnet fixture 200 is rotated around the rotary centroid $\mathbf{0}_2$ so that arm 470 of second fixture 400 is inserted into hook 130 of magnet support 100, first cam 410 of second fixture 400 is rotated to pull spacers 70 and the respective magnet rings 40, 50 and 60 so as to be closely contacted with hook 190 of magnet support 100, thereby fixing the same to prevent their sway. Second cam 420 of second fixture 400 rotates to press main body 110 of magnet support 100 to then be closely contacted with the neck portion.

In other words, by only a bout of rotation of second fixture 400 of second fixture 200, spacers 70 and the respective magnet rings 40, 50 and 60 can be fixed and the magnet assembly can be fixed on the neck portion.

Figure 8:
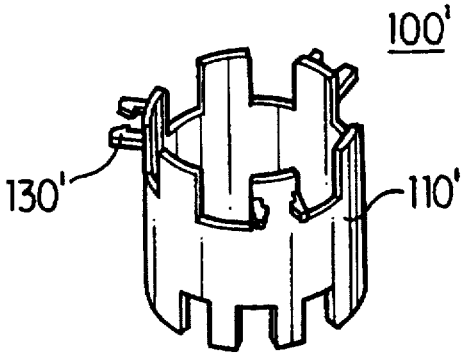
FIG. 8 is a perspective view of a support for the magnet assembly for a CRT according to a second embodiment of the present invention.
Figure 9:
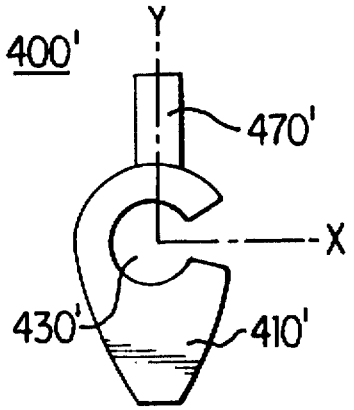
FIG. 9 is a perspective view of a second fixture for the magnet assembly for a CRT according to a second embodiment of the present invention.
Figure 10:
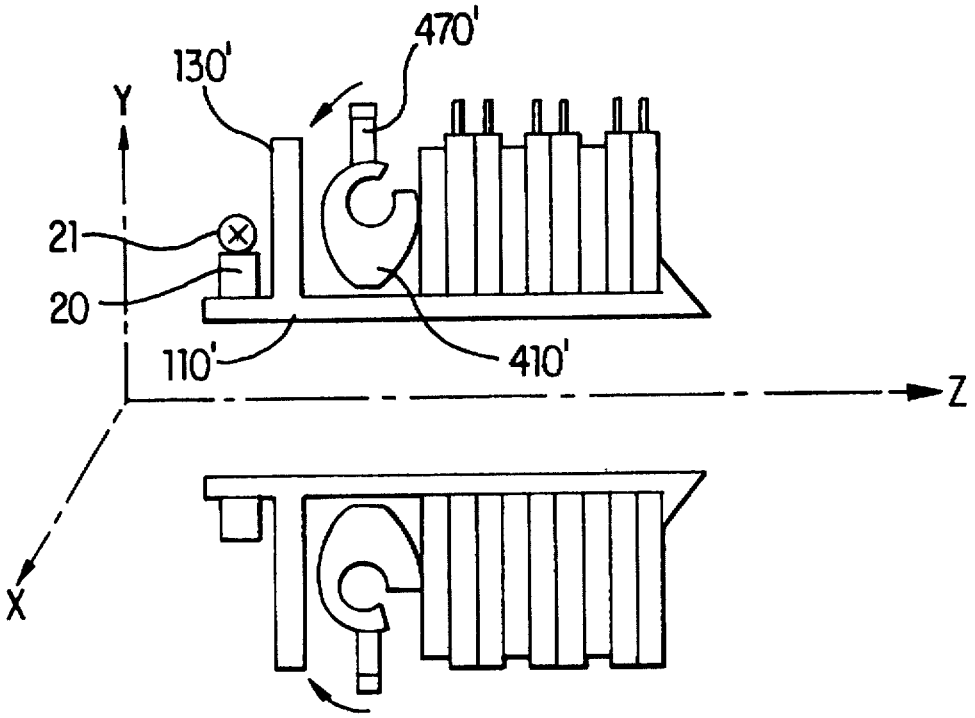
FIG. 10 shows a fabrication state of the magnet assembly for a CRT according to a second embodiment of the present invention.

FIGS. 8 through 10 show the magnet assembly for a CRT according to the second embodiment of the present invention, in which a magnet support 100' includes a hook 130' formed in slightly front of one end of cylindrical main body 110', a second fixture 400 includes a single cam 410', and another structure is the same as that of the first embodiment except that the first embodiment employs a separate fixing means such as the conventional ring band 20 for fixing magnet support 100 on neck portion 2.

As described above, according to the present invention, since the fabrication of a magnet assembly can be implemented by a bout of rotation, the fabrication work is easy and simple. Also, since the number of necessary parts is reduced, the structure is simplified, which causes the reduction of the manufacturing cost.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A magnet assembly for a CRT, installed in the outer periphery of a neck portion incorporating an electron gun for emitting R, G and B electron beams for converging said electron beams on the center of a screen, said magnet assembly comprising:

a magnet support inserted into the outer periphery of said neck portion;

a pair of two-, four- and six-pole magnet rings rotatably installed in the outer periphery of said magnet support; spacers inserted between said pair of magnet rings;

a magnet fixing means rotatably coupled in the outer periphery of said magnet support for fixing said magnet support on said neck portion and preventing said magnet rings and said spacers from being fluctuated on said magnet support; said magnet fixing means including a first fixture coupled to said magnet support and a plurality of second fixtures rotatable coupled to said first fixture; said second fixtures each including a first cam and a second cam integrally formed around a predetermined portion of said first fixture set as a common rotary centroid.

2. A magnet assembly for a CRT as claimed in claim 1, wherein said magnet support includes a cylindrical main body, a hook installed in one end of said main body, a plurality of nodes formed in one end having said hook installed therein in a lateral direction of said main body in a predetermined interval, a node formed in other end of said main body, and a flange formed in other end of said main body, wherein said first fixture includes a ring having a curvature radius larger than the radius of said main body and having a circular section having a predetermined diameter and a plurality of extensions elongated toward center $\mathbf{0}_1$ of said ring, and wherein said second fixtures each includes first and second cams integrally formed and having a common rotary centroid, a circular hole having a diameter corresponding to said predetermined diameter of said ring around said rotary centroid, and into which said ring is inserted, a node linked to said circular hole and externally enlarged therefrom, and an arm formed at a predetermined angle clockwise in terms of said node and inserted into said hook.

3. A magnet assembly for a CRT, installed in the outer periphery of a neck portion incorporating an electron gun for emitting R, G and B electron beams for converging said electron beams on the center of a screen, said magnet assembly comprising:

a magnet support inserted into the outer periphery of said neck portion;

a pair of two-, four- and six-pole magnet rings rotatably installed in the outer periphery of said magnet support; spacers inserted between said pair of magnet rings;

a magnet fixing means rotatably coupled in the outer periphery of said magnet support for fixing said magnet support on said neck portion and preventing said magnet rings and said spacers from being fluctuated on said magnet support; said magnet fixing means including a first fixture coupled to said magnet support and a plurality of second fixtures rotatable coupled to said first fixture; said second fixtures each including a cam with predetermined portion of said first fixture set as its rotary centroid; and a magnet support fixing means for fixing said magnet support on said neck portion.

4. A magnet assembly for a CRT as claimed in claim 3, wherein said magnet support fixing means is a ring band coupled to the outer periphery of said magnet support for closely fixing said magnet support on said neck portion according to elastic shrinkage of its diameter.

* * * * *